US009290878B2

(12) United States Patent
Lee et al.

(10) Patent No.: US 9,290,878 B2
(45) Date of Patent: Mar. 22, 2016

(54) WASHING METHOD

(75) Inventors: Sang Jun Lee, Changwon-si (KR); Young Jong Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1309 days.

(21) Appl. No.: 12/727,458

(22) Filed: Mar. 19, 2010

(65) Prior Publication Data

US 2010/0236001 A1 Sep. 23, 2010

(30) Foreign Application Priority Data

Mar. 20, 2009 (KR) ..... 10-2009-0024103
Nov. 17, 2009 (KR) ..... 10-2009-0111083

(51) Int. Cl.

| | |
|---|---|
| ***D06F 33/00*** | (2006.01) |
| ***D06F 33/02*** | (2006.01) |
| ***D06F 35/00*** | (2006.01) |
| ***D06F 39/00*** | (2006.01) |
| ***D06F 39/08*** | (2006.01) |

(52) U.S. Cl.

CPC ..... *D06F 33/02* (2013.01); *D06F 35/006* (2013.01); *D06F 39/003* (2013.01); *D06F 39/087* (2013.01); *D06F 39/088* (2013.01)

(58) Field of Classification Search

USPC ..... 8/158, 159
See application file for complete search history.

(56) References Cited

U.S. PATENT DOCUMENTS

| | | | | |
|---|---|---|---|---|
| 2003/0005524 | A1 * | 1/2003 | Hayes et al. | 8/159 |
| 2004/0172985 | A1 * | 9/2004 | Mamiya et al. | 68/12.05 |
| 2005/0144734 | A1 * | 7/2005 | Yang et al. | 8/149.3 |
| 2006/0000242 | A1 * | 1/2006 | Yang et al. | 68/5 R |
| 2007/0067920 | A1 | 3/2007 | Zaccone | |
| 2008/0120788 | A1 * | 5/2008 | Do et al. | 8/159 |

FOREIGN PATENT DOCUMENTS

| | | | |
|---|---|---|---|
| JP | 8-196777 | A | 8/1996 |
| KR | 10-1993-0004557 | A | 3/1993 |
| KR | 10-1998-036255 | A | 8/1998 |
| KR | 10-2000-0051554 | A | 8/2000 |

* cited by examiner

*Primary Examiner* — Michael Barr
*Assistant Examiner* — Benjamin L Osterhout
(74) *Attorney, Agent, or Firm* — Birch, Stewart, Kolasch & Birch, LLP

(57) ABSTRACT

Provided is a washing method. The washing method includes: setting a target water level of washing water supplied for a washing cycle; supplying washing water and measuring a time for the washing water to reach the target water level; and setting a spray time for a rinsing cycle conducted after the washing cycle based on the time measured in the step of measuring a time to reach the target water level. Adequate rinsing performance can be achieved even in a region with different water pressure.

4 Claims, 8 Drawing Sheets

WASHING METHOD

This application claims priority from Korean Patent Application No. 10-2009-0024103 field on Mar. 20, 2009 and 10-2009-0111083 filed on Nov. 17, 2009, in the Korean Intellectual Property Office, the disclosure of which is incorporated herein by reference in its entirety.

BACKGROUND

1. Field

The present invention relates to a washing method, and more particularly, to a washing method which can achieve adequate rinsing performance even when the pressure of washing water supplied to a washing tub varies by region and country.

2. Description of the Related Art

In general, a laundry treatment apparatus refers to various kinds of appliances for treating laundry by applying physical and chemical actions to the laundry, including a washing machine for removing contaminants stuck to clothes, beddings and the like (hereinafter, referred to as "laundry") by using a chemical decomposition of water and detergent and a physical action, such as friction between water and laundry, a drying machine for dehydrating and drying wet laundry, and a refresher for preventing allergies caused by laundry and washing laundry easily by jetting steam to the laundry.

Washing machines, which are a kind of laundry treatment apparatus, are classified into an agitator-type washing machine, a drum-type washing machine, and a pulsator-type washing machine according to the structure and washing manner. In general, such a washing machine washes laundry by sequentially performing a washing cycle, a rinsing cycle, and a dehydrating cycle. A user may select only some of the above-mentioned cycles, and a proper washing method is selected according to the type of laundry.

A conventional washing machine cannot reflect water pressures of water supply varying from region to region, and hence, in case of a washing machine installed in a region with low water pressure, cannot make laundry received in the washing tub soaked adequately during a water supply process.

BRIEF SUMMARY OF THE INVENTION

A washing method according to the present invention includes the steps of: setting a target water level of washing water supplied for a washing cycle; supplying washing water and measuring a time for the washing water to reach the target water level; and setting a spray time for a rinsing cycle conducted after the washing cycle based on the time measured in the step of measuring a time to reach the target water level.

Alternatively, a washing method according to the present invention, in which washing water is supplied into a washing tub so that a predetermine amount of washing water is stored in the washing tub to wash laundry contained in the washing tub, and washing water is sprayed to the laundry to perform rinsing after completion of the washing, the washing method including the steps of: setting a target water level of washing water supplied into the washing tub for the washing and supplying washing water until the target water level is reached; setting a spray time for the rinsing depending on a time for the water level of the washing water supplied for the washing to reach the target water level; draining the washing water in the washing tub after completion of the washing; and spraying washing water according to the set spray time to rinse the laundry.

The washing method according to the present invention has the advantage of achieving adequate rinsing performance regardless of the water pressure characteristics of a region by setting a spray time for rinsing in consideration of the water pressure of the region where a washing machine is used.

Furthermore, the washing method according to the present invention has the advantage of performing rinsing by reflecting the water pressure characteristics of an environment where a washing machine is used without using any particular water pressure sensor.

Furthermore, the washing method according to the present invention does not need to add a process for measuring water pressure since water pressure is estimated using the characteristics of water supply which is generally done for washing.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
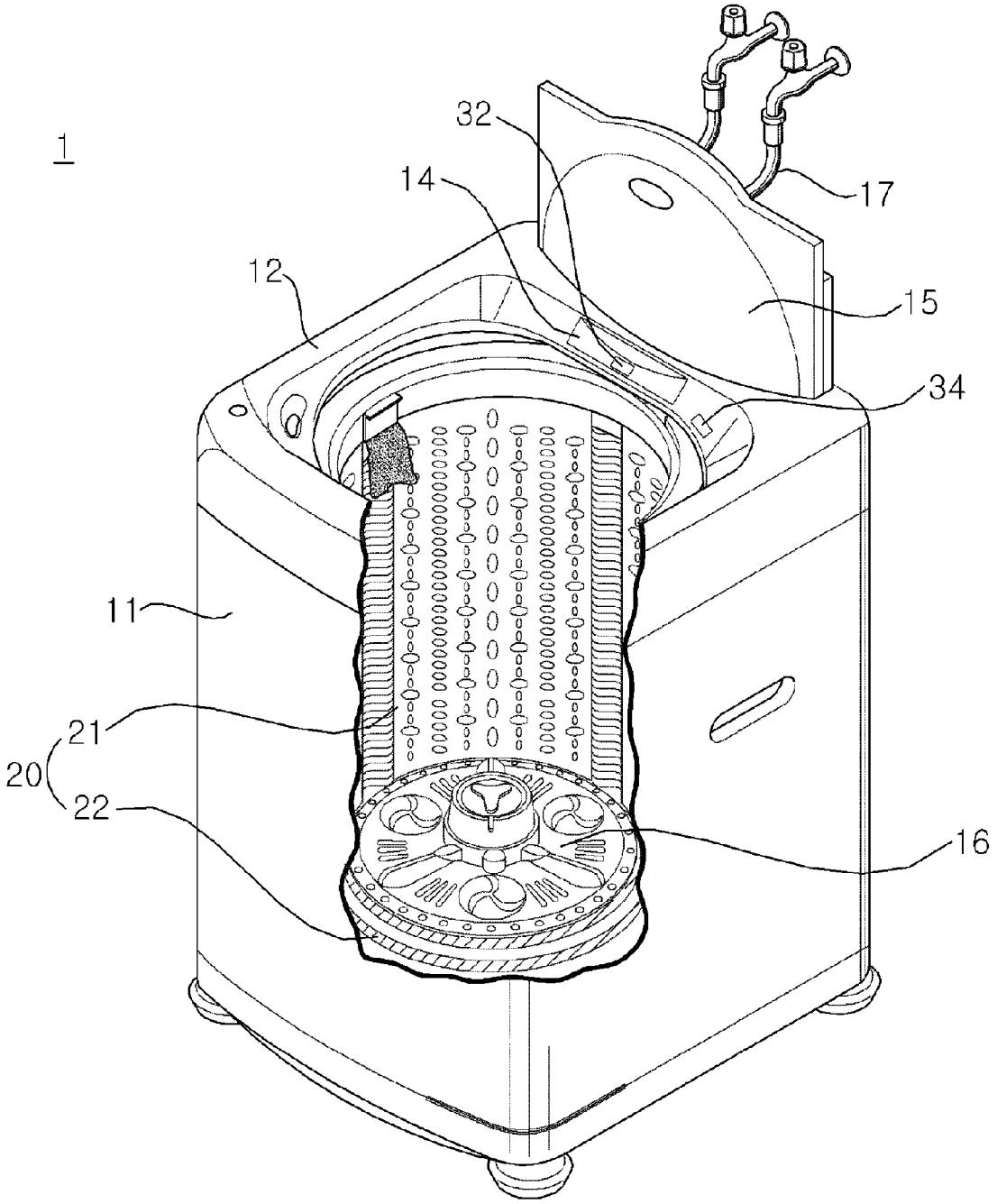
FIG. 1 is a perspective view of a laundry treatment apparatus according to one exemplary embodiment of the present invention.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout.

Figure 2:
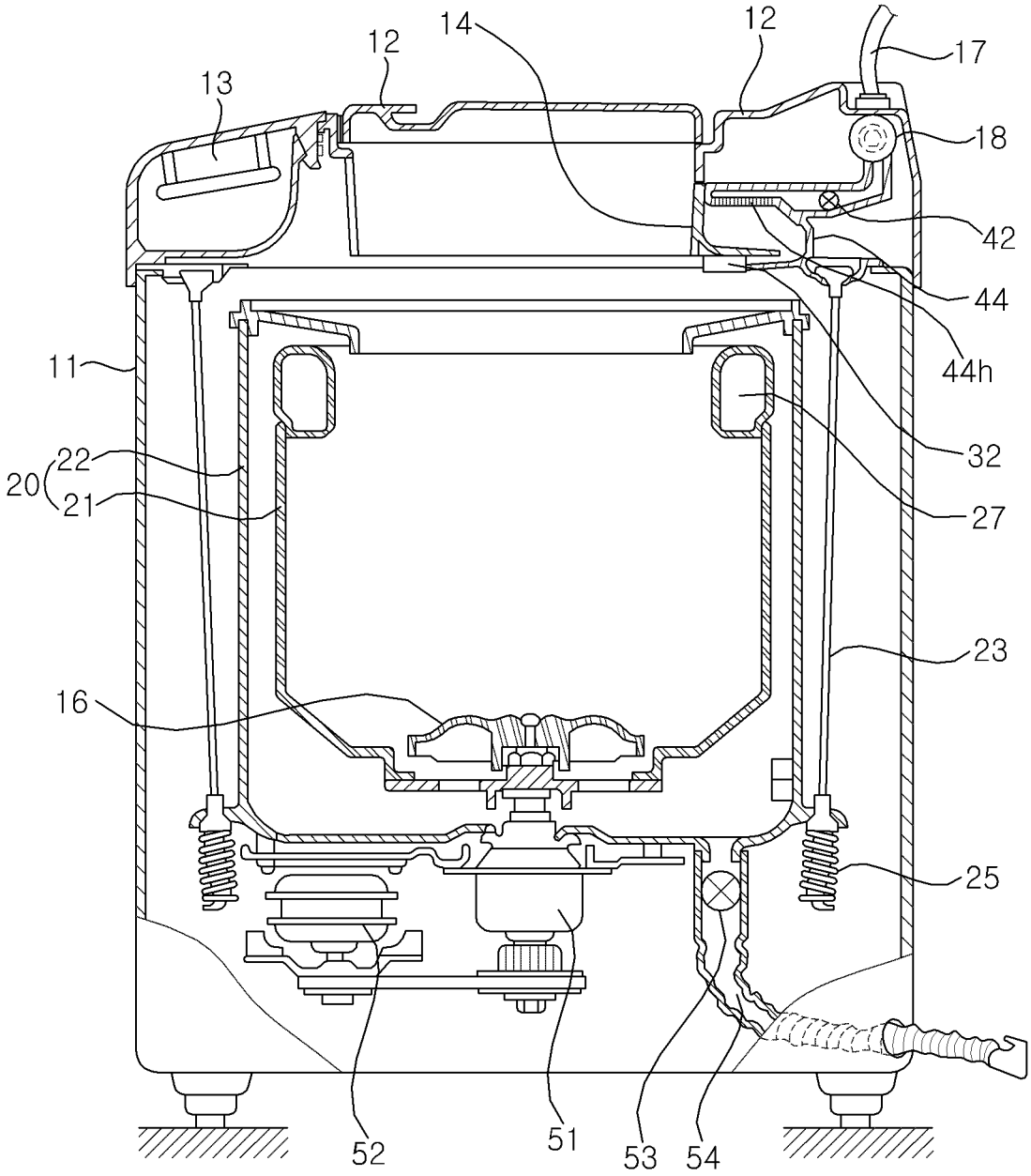
FIG. 2 is a side cross-sectional view of the laundry treatment apparatus shown in FIG. 1.
Figure 3:
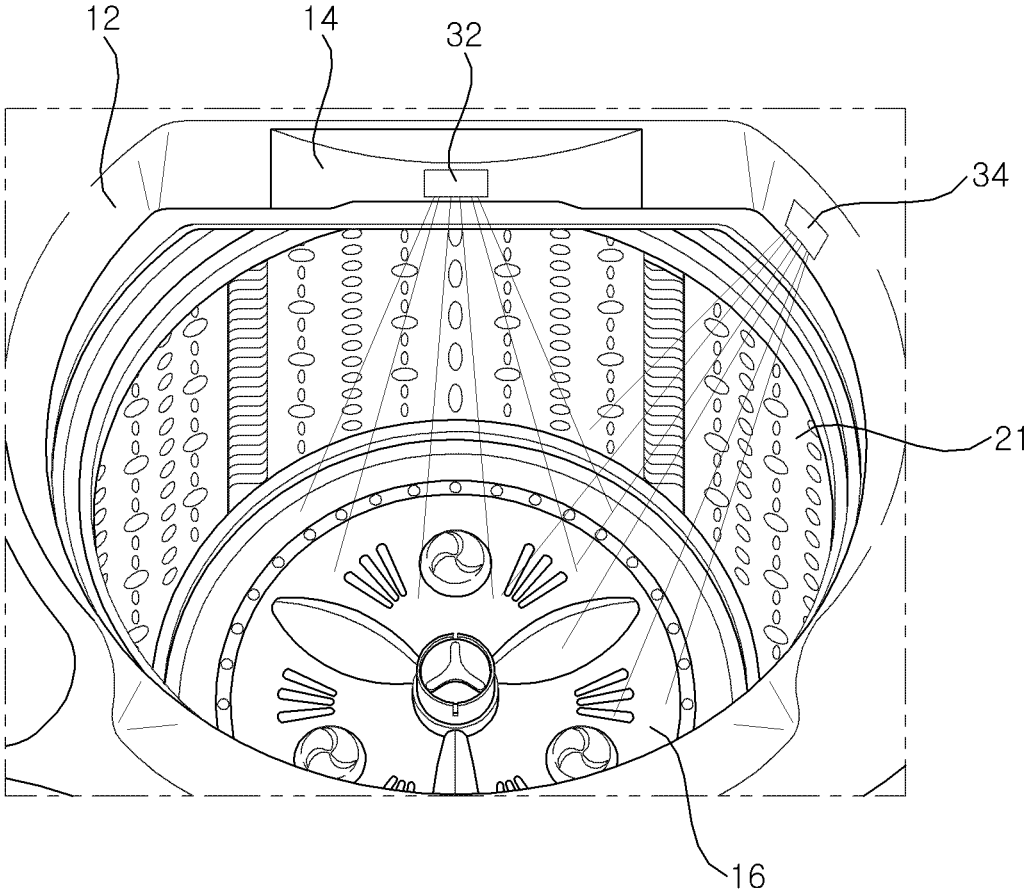
FIG. 3 is a schematic view of the laundry treatment apparatus for explaining the spraying of washing water according to the water pressure of the washing water introduced into a spraying unit.
Figure 4:
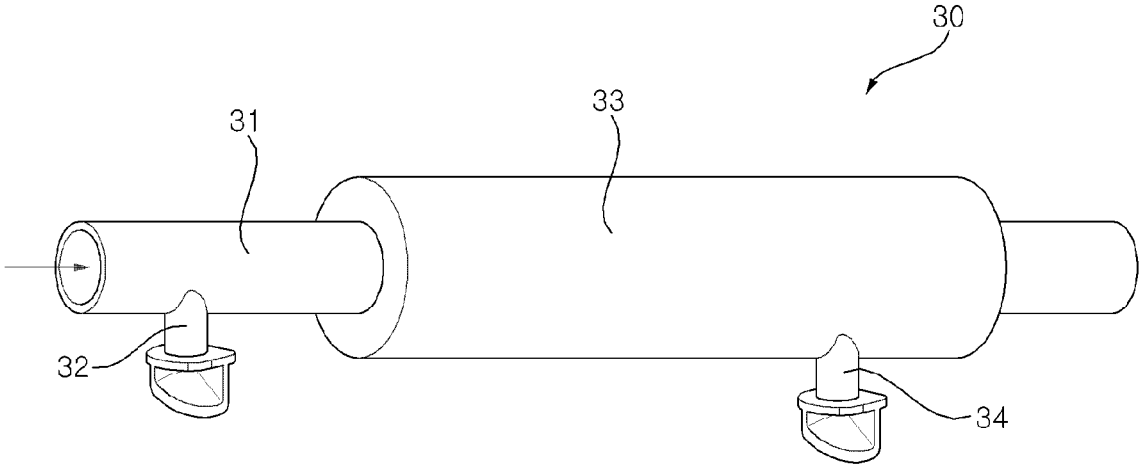
FIG. 4 is a perspective view showing the spraying unit which is one of the components of FIG. 1.

FIG. 1 is a perspective view of a laundry treatment apparatus 1 according to one exemplary embodiment of the present invention, FIG. 2 is a side cross-sectional view of the laundry treatment apparatus 1 shown in FIG. 1, FIG. 3 is a schematic view of the laundry treatment apparatus for explaining the spraying of washing water according to the water pressure of the washing water introduced into a spraying unit, and FIG. 4 is a perspective view showing the spraying unit 30, which is one of the components of FIG. 1.

Referring to FIGS. 1 to 4, the laundry treatment apparatus 1 comprises a washing tub 20 provided in a main body 11 forming an external appearance of the laundry treatment apparatus 1 and washing laundry received therein, a door 12 rotatably mounted on the main body 11 for putting laundry in and out of the washing tub 20, a control unit 13 for controlling an overall operation of the laundry treatment apparatus 1, a detergent box 14 mounted at the main body 11 so as to be taken in and out, a detergent box housing 44 accommodating the detergent box 14, a water supply passage 17 connected to an external water source to receive washing water, a water supply valve 18 for controlling the water supply passage 17, a spraying unit 30 for spraying the washing water introduced through the water supply passage 17 into the washing tub 20, a water drain passage 54 for discharging the washing water in the washing tub 20 to the outside, and a water drain valve 53 for controlling the water drain passage 54.

The washing tub 20 comprises an outer tub 22 for containing washing water therein and an inner tub 21 rotatably disposed in the outer tub 22 for receiving laundry therein. The inner tub 21 has a plurality of through holes (not shown) formed therein to circulate the washing water between the outer tub 22 and the inner tub 21. A pulsator 16 is rotatably disposed on the bottom of the inner tub 21 to generate a rotating water stream, and an auto-balancer 50 is provided at an upper portion of the inner tub 21. The auto-balancer 50 is for reducing vibration generated depending on the eccentricity of laundry, and may be implemented as a liquid balancer, a ball balancer, or the like.

The outer tub 22 is suspended on the main body 11 by a supporting member 23, and a damper 25 for damping vibration is provided at one end of the supporting member 23. A clutch 51 for selectively rotating the inner tub 21 and the pulsator 16 forward and backward and a motor 52 are disposed under the outer tub 22.

One portion of the washing water introduced into the water supply passage 17 flows into a spraying passage 31, and the other portion of the washing water flows into the detergent box 14 through a water hole 44*h* formed in the detergent box housing 44, mixed with a detergent, and then supplied to the washing tub 20. An auxiliary valve 42 may be provided to control the washing water introduced into the detergent box 14.

The spraying unit 30 may comprise the spraying passage 31 connected to the water supply passage 17 and nozzles 32 and 34 connected to the spraying passage 31. In the laundry treatment apparatus 1 according to one exemplary embodiment of the present invention, the spraying unit 30 comprises a plurality of nozzles 32 and 34. That is, the spraying unit 30 comprises the spraying passage 31 and the plurality of nozzles 32 and 34.

Referring to FIG. 4, the plurality of nozzles 32 and 34 are branched from the spraying passage 31 serving as a main pipe, and comprise a first nozzle 32 and a second nozzle 34 which are disposed on the spraying passage 31, spaced apart from each other, for spraying washing water to the washing tub 20. Preferably, a spray direction of the first nozzle 32 and a spray direction of the second nozzle 34 are arranged so as not to disturb each other.

The first nozzle 32 is always opened regardless of the water pressure of introduced washing water which varies by region or country (i.e., even if the water pressure is small), and supplies the washing water to the washing tub 20, thereby enabling a user to operate the laundry treatment apparatus 1 and performing a washing cycle and a rinsing cycle.

On the contrary, the second nozzle 34 is opened only when the water pressure is greater than a predetermined value and supplies washing water to the washing tub 20 by fully reflecting different water pressure characteristics of introduced washing water for different regions or countries.

The spraying unit 30 may further comprise an on-off controller 35 for opening and closing the second nozzle 34 according to the water pressure of introduced washing water. Detailed configurations and functions of the on-off controller 35 will be described later.

The laundry treatment apparatus 1 according to one exemplary embodiment of the present invention having the aforementioned configuration brings about a water saving effect which allows the user to use only a small amount of washing water because washing water is sprayed directly to the laundry received in the washing tub 20 using the plurality of nozzles 32 and 34 to thus making the laundry evenly soaked.

Moreover, the laundry treatment apparatus 1 has the advantage of fully reflecting different water pressures for different regions or countries in such a manner as to supply washing water to the washing tub 20 by opening the first nozzle 32 only without opening the second nozzle 34 in case of a region or country with low water pressure, whereas to supply washing water to the washing tub 20 by opening both of the first and second nozzles 32 and 34 in case of a region or country with high water pressure.

As such, there is the advantage of evenly soaking the entire laundry with sufficient water pressure by spraying washing water to the laundry of the washing tub 20 using only one nozzle (i.e., first nozzle 32) in a place with low water pressure.

Furthermore, there is the advantage of evenly soaking the entire laundry with a similar spraying pressure to that used in the water supply using only one nozzle because washing water is sprayed using the plurality of nozzles (i.e., first and second nozzles 32 and 34) in a place with high water pressure. Whether to keep the second nozzle 34 opened or closed is determined depending on the water pressure of the region concerned.

As stated above, the laundry treatment apparatus 1 according to one exemplary embodiment of the present invention is provided with the on-off controller 35 for opening and closing the second nozzle 34 according to the water pressure of introduced washing water.

Figure 5A:
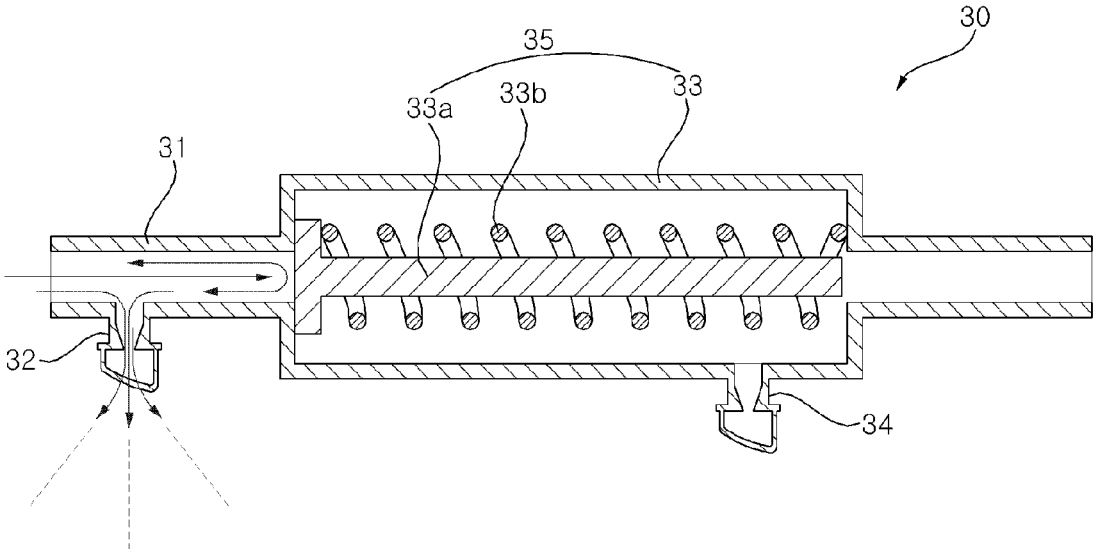
FIGS. 5*a* and 5*b* are cross-sectional views showing an operating process of the spraying unit.
Figure 5B:
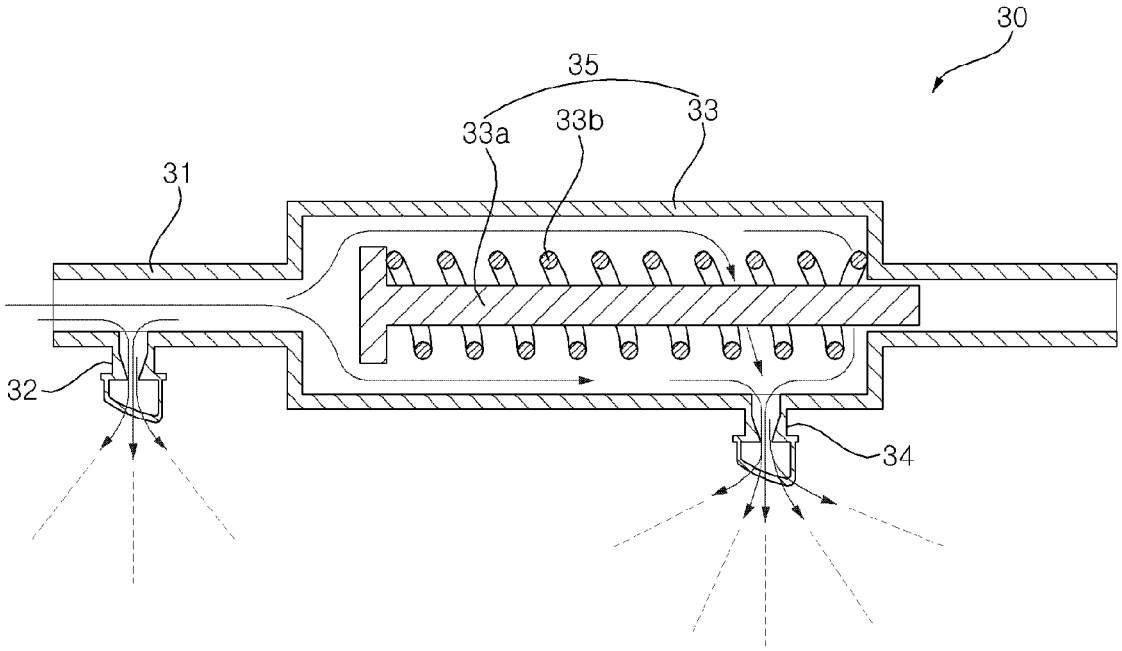

FIGS. 5*a* and 5*b* are cross-sectional views showing an operating process of the spraying unit 30.

Referring to FIGS. 5*a* and 5*b*, the on-off controller 35 comprises a communication pipe 33 having an inlet communicating with the spraying passage 31 and an outlet communicating with the second nozzle 34, a piston 33*a* for opening and closing the outlet while linearly moving in the communication pipe 33, and an elastic member 33*b* connected to the piston 33*a* to elastically supporting the piston 33*a* toward the inlet.

That is, the piston 33*a* is disposed to be linearly movable in the communication pipe 33, and the piston 33*a* blocks the inlet of the communication pipe 33 as it is elastically supported toward the inlet of the communication pipe 33 by the elastic member 33*b*. Thus, no water is introduced into the communication pipe 33 as long as the water pressure is not higher than a predetermined value. Then, the second nozzle 34 is kept closed since the water pressure is not greater than the predetermined value, thus failing to perform the water supply function.

Here, the predetermined value of water pressure is set by the spring constant K of the elastic member 33*b*. Accordingly, it is preferred that the elastic member 33*b* has a spring constant K within an appropriate range considering water pressure in a region with high water pressure and water pressure in a region with low water pressure. Especially, the elastic member 33*b* may be provided as a spring.

Referring to FIG. 3, the spraying unit 30 can spray washing water toward the inside surface of the inner tub 21. If the water pressure of the washing water passing through the spraying passage 31 is high, the plurality of nozzles 32 and 34 are all opened, thereby spraying the washing water into the washing tub 20.

Of course, if the plurality of nozzles 32 and 34 are all opened, the degree at which the washing water is sprayed to the inner tub 21 varies depending on water pressure. That is, the washing water is sprayed toward a higher part of the inner tub 21 as the pressure of the washing water passing through the spraying passage 31 becomes higher, while the washing water is sprayed toward a lower part of the inner tub 21 as the pressure of the washing water passing through the spraying passage 31 becomes lower.

Figure 6:
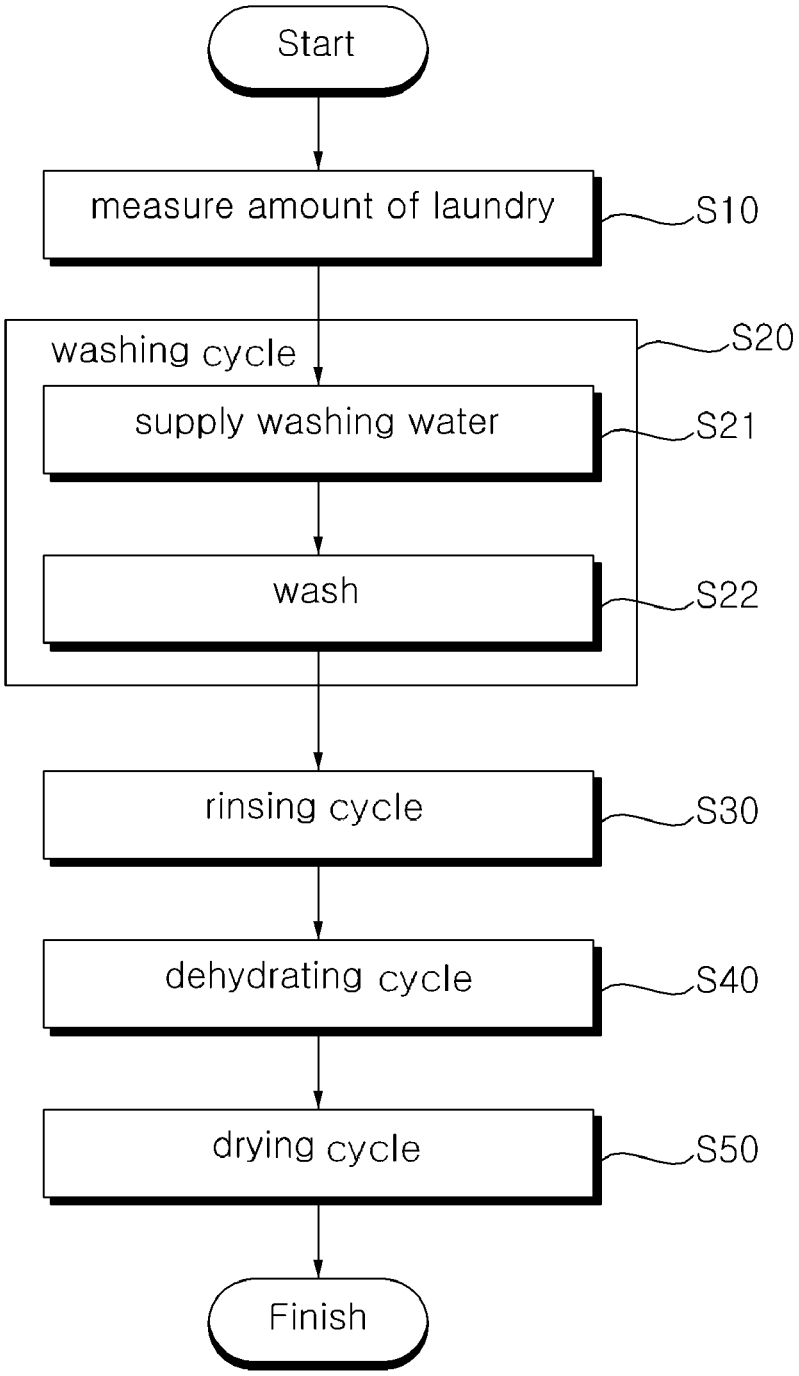
FIG. 6 is a flowchart of a washing method according to one exemplary embodiment of the present invention.

FIG. 6 is a flowchart of a washing method according to one exemplary embodiment of the present invention.

When laundry is loaded into the inner tub 21, and the operation of the laundry treatment apparatus 1 is started, a laundry amount measuring step S10 is performed to measure an amount of the loaded laundry.

An amount of water supply is set depending on the amount of the laundry measured in the laundry amount measuring step S10. The control unit 13 sets an amount of water supply by comparing a set data value with the measured amount of the laundry so as to perform an optimal washing according to the amount of the laundry.

Then, a washing cycle S20 is performed, and the control unit 13 controls the water supply valve 17 to be opened until the water level in the washing tub 20 reaches an appropriate water level based on the measured amount of the laundry, whereby the washing water supply S21 is performed. During the supply of washing water S21, washing water passing through the detergent box and mixed with a detergent may be supplied into the washing tub 20.

After the washing water supply S21, washing S22 is performed, in which contaminants are removed from the laundry using a water stream, generated by the rotation of the inner tub 21 and/or the pulsator 16, an interaction with the detergent, and a friction with the pulsator 16 while the inner tub 21 and/or the pulsator 16 rotates. During the washing step S22, the control unit 13 properly controls the rotational speed and rotational direction of the motor 52 and the clutch 52 so that the inner tub 21 is continuously rotated in one direction or repeatedly rotated in both directions, alternately, or so that the pulsator 16 is continuously rotated in one direction or repeatedly rotated in both directions, alternately. Of course, the inner tub 21 and the pulsator 16 may be controlled to be rotated simultaneously in the aforementioned manner.

However, the laundry amount measuring step S10 is not necessarily done before the washing cycle S20 but it is sufficient if the laundry amount measuring S10 is performed at an appropriate point of time before washing water is sprayed by the spraying unit 30. It is not intended that the scope of the present invention be limited to a point of time when the laundry amount measuring step S10 is performed. However, if the amount of the laundry is measured after the laundry is soaked in the washing water, the absorption rate of the washing water varies with the type of the laundry, and this makes it difficult to measure a correct amount of the laundry. Thus, it is preferable that the laundry amount measuring step S10 is performed before the laundry is soaked.

A rinsing cycle S30 is a step of removing the detergent and contaminants stuck to the laundry while the inner tub 21 and/or the pulsator 16 rotates in a similar way to the washing cycle S20. Unlike the washing cycle S20, clean washing water, not mixed with detergent, is sprayed, and in some cases, washing water mixed with laundry additives, such as a fabric softener and bleaching agents, may be sprayed. The rinsing cycle S30 may comprise a step of performing spraying by the spraying unit 30 during rotation of the inner tub 21. In this case, the laundry can be uniformly rinsed even if the spray direction of the spraying unit 30 is fixed.

Moreover, the first nozzle 32 and/or the second nozzle 34 may be disposed to face the inside surface of the inner tub 21, and drainage may be done simultaneously with the spraying during rotation of the inner tub 21. In this case, the sprayed washing water is drained immediately, thus preventing the laundry from being contaminated again by the contaminated washing water while rinsing the laundry. At this time, it is preferred that the inner tub 21 is rotated at such a speed as to make the laundry stuck to the inside surface of the inner tub 21 by a centrifugal force.

After the rinsing cycle S30, a dehydration cycle S40 is performed to dehydrate the laundry as the inner tub 21 rotates at high speed and drain the washing water used in dehydration to the outside. Then, in case of a washing machine, such as a combined dryer and washing machine, capable of performing a drying function, a drying cycle S50 is performed to supply hot air or cold air into the washing tub 20 and dry the laundry.

Although in this exemplary embodiment the washing cycle S20, the rinsing cycle S30, the dehydration cycle S40, and the drying cycle S50 are sequentially performed, it is needless to say that the user can select which cycles to perform.

Meanwhile, it is an important problem how to set the spray time of the washing water by the spraying unit 30 during the rinsing cycle S30. The spray time is set by the user at an early stage of use of the washing machine, and is preferably set in consideration of the water pressure characteristics of the region concerned.

The spray time is set longer than that of a region with high water temperature if the water pressure of the region concerned is low, and the spray time is set shorter than that of a region with low temperature if the water pressure of the region concerned is high, thereby achieving adequate rinsing performance regardless of the water pressure characteristics of the region concerned.

Especially, in the case that a plurality of nozzles 32 and 34 are provided, branched from one spraying passage 31, as shown in this exemplary embodiment, if the water pressure is high, both of the first and second nozzles 32 and 34 can simultaneously perform spraying, thus achieving adequate rinsing performance, but if the water pressure is low, only the first nozzle 32 is opened, thus lowering rinsing performance.

Accordingly, in order to achieve adequate rinsing performance, the spray time for low water pressure under which spraying is done by the first nozzle 32 only has to be set longer than that for high water pressure under which spraying is done by both of the first and second nozzles 32 and 34.

Consequently, the present invention proposes a washing method that finds out water pressure characteristics by measuring a time to reach a set water level during the washing water supply S21 and increases and decreases a washing water spray time for the rinsing cycle S30 based on the water pressure characteristics in order to achieve adequate rinsing performance even in a region or country with different water pressure.

Figure 7:
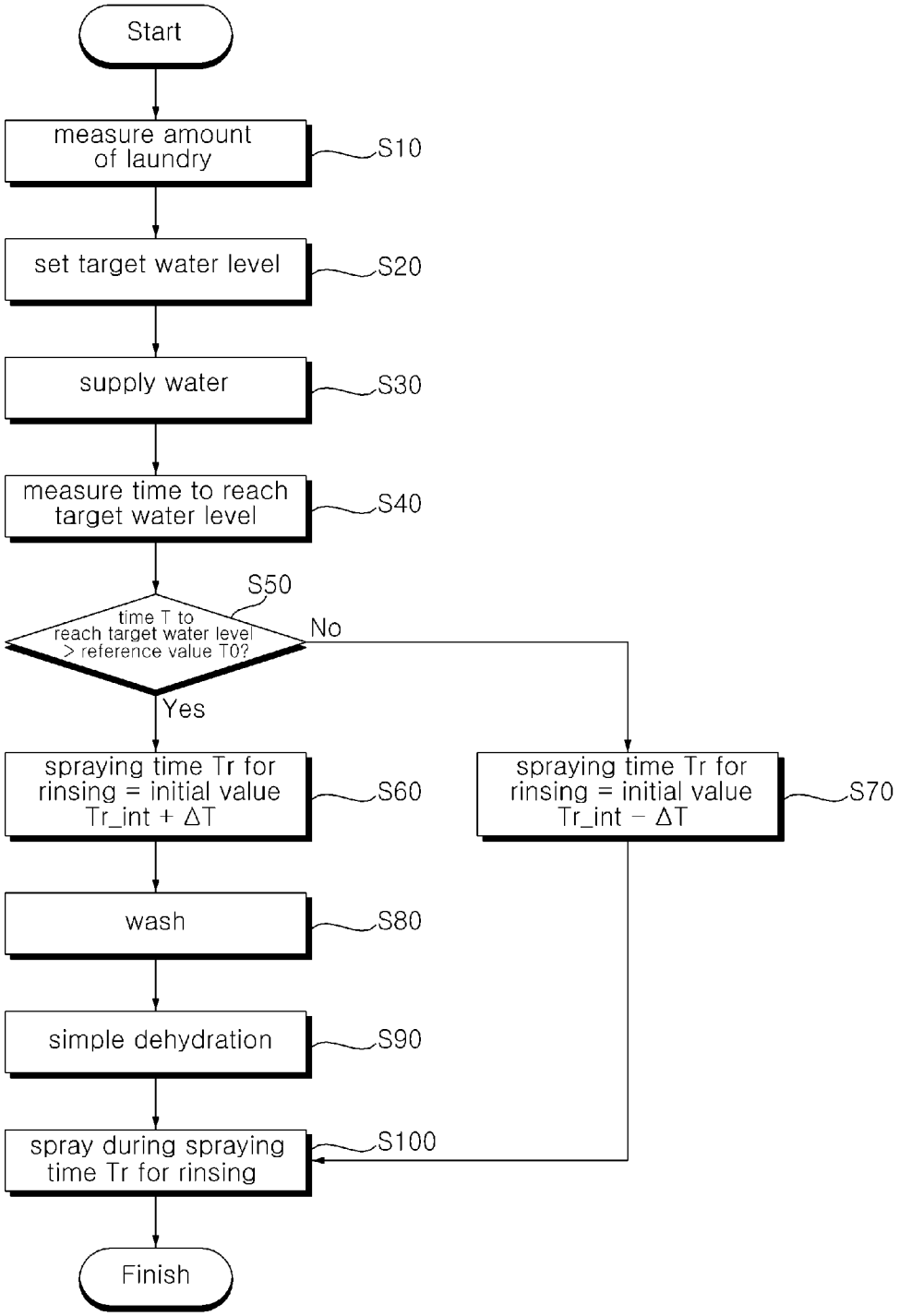
FIG. 7 is a flowchart of a method of setting a spray time for the rinsing cycle, which shows, more specifically, the washing method according to one exemplary embodiment of the present invention as shown in FIG. 6.

FIG. 7 is a flowchart of a method of setting a spray time for the rinsing cycle, which shows, more specifically, the washing method according to one exemplary embodiment of the present invention shown in FIG. 6.

When laundry is loaded into the inner tub 21, and the operation of the washing machine 1 is started, the amount of the loaded laundry is measured S10.

Thereafter, the control unit 13 sets a target water level, which is a reference amount of washing water supplied into the washing tub 20, depending on the amount of laundry measured in the laundry amount measuring step S10. That is, the control unit 13 sets the target water level to a high value if the measured amount of the laundry is large and the target water level to a low value if the measured amount of the laundry is small so that an adequate amount of washing water is supplied depending on the amount of the laundry.

After that, water supply S130 into the washing tub 20 is performed until the target water level is reached. A time T to reach the target water level is measured S40, and a washing water spray time Tr for the rinsing cycle is set based on the measured time T.

The step of setting the spray time Tr for the rinsing cycle includes a step S150 of comparing the time T to reach the target water level with a reference value T0 and steps S160 and S170 of increasing and decreasing the spray time for the rinsing cycle set as an initial value Tr_int according to a result of the comparison. The reference value T0 is a value preset according to an amount of the laundry, which is a measured value of the time to reach the target water level according to the target water level varying with the amount of the laundry under a constant water pressure P0. Accordingly, if the time T to reach the target water level is greater than the reference value T0, this means that a water pressure of a place where the washing machine 1 is installed is lower than P0, and if the time T to reach the target water level is less than T0, this means that a water pressure of the place is higher than P0.

Therefore, if the measured time T to reach the target water level is larger than the reference value T0, the control unit 13 sets the spray time Tr for the rinsing cycle to be greater than the initial value Tr_int, i.e., equal to Tr_int+Δ T S160. On the other hand, if the measured time T to reach the target water level is less than the reference value T0, the control unit 13 sets the spray time Tr for the rinsing cycle to be less than the initial value Tr_int, i.e., equal to Tr_int−Δ T S170.

An increase in time Δ T may be set as a value proportional to a difference between the time T to reach the target water level and the reference value T0. In this case, the spray time Tr for the rinsing cycle can be set by more accurately reflecting the water pressure characteristics of the region concerned where the laundry treatment apparatus 1 is installed.

Afterwards, a washing cycle is performed by carrying out washing S180 for removing contaminants from the laundry using a water stream, generated by the rotation of the inner tub 21 and/or the pulsator 16, interaction with the detergent, and friction with the pulsator 16 while the inner tub 21 and/or the pulsator 16 rotates, and then simple dehydration S190 for dehydrating the laundry while the inner tub 21 rotates at high speed. After that, a rinsing cycle is performed. In the rinsing cycle, washing water is sprayed during the spray time Tr set by the aforementioned process S200.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing method comprising:

measuring an amount of laundry in an inner tub;

operating a washing cycle that includes:

setting a target water level, a reference value and a spraying time according to the measured amount of the laundry;

filling the inner tub, through a detergent box, with washing water introduced from an external water source, until a water level in the inner tub reaches the target water level, and measuring a time taken for the water level to reach the target water level;

adjusting the spraying time based on a difference between the measured time and the reference value; and washing the laundry by rotating at least one of the inner tub and a pulsator; and operating a rinsing cycle that includes spraying, through one or more nozzles, washing water introduced from the external water source into the inner tub for a period of the adjusted spraying time, and rotating the inner tub and draining the inner tub, wherein the reference value is set as a time for the water level to reach the target water level when the washing water introduced from the external water source with a given constant pressure.

2. The washing method of claim 1, wherein adjusting the spraying time includes increasing the spraying time when the measured time is greater than the reference value.

3. The washing method of claim 1, wherein adjusting the spraying time includes decreasing the spraying time when the measured time is less than the reference value.

4. The washing method of claim 1, wherein an adjusted amount of the spraying time is proportional to the difference between the measured time and the reference value.

* * * * *